US006041297A

United States Patent [19]

Goldberg

[11] Patent Number: 6,041,297

[45] Date of Patent: Mar. 21, 2000

[54] VOCODER FOR CODING SPEECH BY USING A CORRELATION BETWEEN SPECTRAL MAGNITUDES AND CANDIDATE EXCITATIONS

[75] Inventor: Randy G. Goldberg, Princeton, N.J.

[73] Assignee: AT&T Corp, New York, N.Y.

[21] Appl. No.: 08/814,130

[22] Filed: Mar. 10, 1997

[51] Int. Cl.[7] ..... G10L 3/02; G10L 9/00

[52] U.S. Cl. ..... 704/219; 704/220; 704/223

[58] Field of Search ..... 704/219, 220, 704/223

[56] References Cited

U.S. PATENT DOCUMENTS

| | | | |
|---|---|---|---|
| 4,868,867 | 9/1989 | Davidson | 704/219 |
| 4,899,385 | 2/1990 | Ketchum | 704/219 |
| 5,504,834 | 4/1996 | Fette | 704/219 |

FOREIGN PATENT DOCUMENTS 0 296 763 12/1988 European Pat. Off. .

OTHER PUBLICATIONS

Daniel W. Griffin, Jae S. Lim, "Multiband Excitation Vocoder", IEEE Transactions on Acoustics, Speech, and Signal Processing, vol. 36, No. 8, Aug. 1988.

Parsons TW, voice and speech proc, ch. 10, voice encod. and synth., McGraw Hill, pp. 269, 330, Jun. 1987.

Lupini et al. "Excitation Modeling Based On Speech Residual Information" Speech Processing 1, pp. 23–26 (Mar. 1992).

Yang et al. "A 5.4 KBPS Speech Coder Based On Multi–Band Excitation And Linear Predictive Coding" Proceedings Of the Region 10th Annual International Conference, vol. 1, conf. 9, pp. 417–421 (Aug. 1994).

Griffin and Lim, Multiband Excitation Vocoder, IEEE, 1998, pp. 1223–35.

*Primary Examiner*—David R. Hudspeth
*Assistant Examiner*—Robert Louis Sax

[57] ABSTRACT

A vocoder according to the present invention includes an analyzer portion and a synthesizer portion. The analyzer portion encodes an input frame of speech on the basis of a candidate excitation selected from a group of candidate excitations stored in memory. Instead of transmitting the actual candidate excitation to the synthesizer portion, the analyzer portion generates and provides to the synthesizer portion a variable length index code that identifies the selected candidate excitation. The synthesizer portion stores in memory the same plurality of candidate excitations as the analyzer portion. The synthesizer portion uses the variable length index code to obtain from its memory the candidate excitation originally selected by the analyzer portion. The synthesizer portion reconstructs the input frame of speech on the basis of the obtained candidate excitation.

20 Claims, 5 Drawing Sheets

| | | | | | | |
|---|---|---|---|---|---|---|
| 400 | V | U | U | U | U | V |
| 300 | U | U | V | V | V | U |
| 200 | U | V | U | U | V | V |
| 100 | V | V | V | U | V | V |
| 0 | | | | | | |

VOCODER FOR CODING SPEECH BY USING A CORRELATION BETWEEN SPECTRAL MAGNITUDES AND CANDIDATE EXCITATIONS

BACKGROUND OF THE INVENTION

The present invention is directed to low bit rate coding and decoding of speech, and in particular, to the use of the correlation that exists between the spectral weights and excitations that characterize speech in order to establish such low bit rate coding and decoding.

High-quality, low bit rate coding of speech is important for a variety of applications, such as reduction of storage usage and reduction of transmission bandwidth. It has long been known that traditional methods of coding signals such as voice and audio waste transmission capacity. See J. L. Flanagan, Speech Analysis, Synthesis and Perception, Springer-Verlag, New York, N.Y., 1972; and R. E. Crochiere and J. L. Flanagan, The Technology of Digital Speech Compression, Editing and Storage, National Computer Conference Record, May, 1983. For example, conventional Pulse Code Modulation (PCM)—the method used for digital telephone transmission for many years—relies upon sampling the signal at the Nyquist rate and quantizing it (usually non-linearly) to a sufficiently large number of bits so that the quantization noise (i.e., the error in digital approximation of the signal) is not objectionable. This coding method strives for accurate representation of the time waveform, and recognizes the ability of the ear to detect additive noise that has only a small degree of correlation with the signal. Furthermore, this coding method recognizes that the auditory system is not as sensitive to multiplicative noise that is highly correlated with the speech signal. There are other properties of human audition which, if observed and satisfied, can lead to much greater economics in digital representation of the speech signal.

Tremendous data reduction can be achieved when coding speech signals by taking advantage of the fact that speech is generated by the human vocal system. The process of simulating constraints of the human vocal system to perform speech coding is called vocoding (from voice coding).

Efficient vocoders are useful for many speech processing techniques. High speech intelligibility is possible at much lower bit rates than would be possible with direct coding of the speech waveform. Presently, success has been found by coding speech with formant vocoders, LPC (linear prediction) vocoders, homomorphic vocoders, and channel vocoders. In all these vocoders, speech is modeled as segments, each one of which is the response of a linear system excited by an excitation signal usually made up of either a periodic impulse train (or modified to resemble a vocal-cord pulse train), random noise, or an appropriate combination of the two. For every short-time segment of the vocoded speech, the excitation parameters and parameters of the linear system are determined.

For a complete understanding of this coder, it is important to have a grasp of the linguistic, physiological and acoustic levels of speech and hearing. One must also understand present day technology in voice coding and information quantization. Speech coding can be performed much more efficiently than coding of arbitrary acoustic signals because of the increased knowledge that speech must have originally been produced by the human vocal tract. This additional knowledge gives insight into the structure of the speech signal.

A helpful way of demonstrating what happens during speech is to describe the simple example of two people taking to each other in which the speaker transmits vocalized information to the listener. The chain of events employed in transmitting this information will be referred to as the speech chain. See P. B. Denes and E. N. Pinson, The Speech Chain: The Physics and Biology of Spoken Language, Waverly Press Inc., Baltimore, Md., 1963. The speaker first arranges his thoughts, decides what he wants to say and puts these thoughts into a linguistic form. The message is put into linguistic form by selecting the appropriate words and phrases and placing these words in the correct order as required by the grammatical structure of the language. This process is associated with activity in the speaker's brain, where the appropriate instructions, in the form of impulses along motor nerves, are sent to the muscles that control the vocal organs: the tongue, the lips, and the vocal chords. These nerve impulses cause the vocal muscles to move in such a way as to produce slight pressure changes in the surrounding air. These pressure changes propagate through the air in the form of a sound wave.

The sound wave propagates to the ear of the listener and activates the listeners hearing mechanism. The hearing mechanism produces nerve impulses that travel along the acoustic nerve (a sensory nerve) to the listeners brain. A considerable amount of neural activity is already taking place in the listeners brain when the nerve impulses arrive via the acoustic nerve. This neural activity is strengthened by the nerve impulses arriving from the ear. This modification of brain activity brings about recognition and understanding of the speaker's message.

The speakers auditory nerve brings feedback information to the speakers brain. The speaker continuously compares the quality of sounds he/she produces with the sound qualities he/she intended to produce and makes the adjustments necessary to match the results with his/her intentions. P. B. Denes and E. N. Pinson, The Speech Chain: The Physics and Biology of Spoken Language; Waverly Press, Inc., Baltimore, Md., 1963. This lack of feedback partially explains why the hearing impaired have difficulty speaking clearly and properly.

The above discussion shows how speech starts off in the linguistic level of the speech chain in the speakers brain by the selection of suitable words and phrases, and ends up in the linguistic level in the listeners brain when it deciphers the neural activity brought on through the acoustic nerve. Speech descends from the linguistic level in the speaker to the physiological level as it is being pronounced, and transformed into the acoustic level by the speaker. The listener then brings it back to the physiological level during the hearing process and then deciphers the sensations caused in this level into the linguistic level. We can use our knowledge of the processes that take place in each of these levels to assist in development of a speech coder.

Speech sounds are produced by air escaping through the lungs and then partially converted into fluctuating energy by one of the following mechanisms (the excitation signal):

(1)chopping up of the steady flow of air into quasi-periodic pulses by the vocal cords, in which energy is provided in this way for excitation of voiced sounds such as the vowels;

(2) noise-like turbulence being created at some point in the vocal tract due to a constriction; (3) the sudden release of excess pressure following a complete closure of the vocal tract somewhere along its length causing a single high energy pulse of energy, in which energy is provided in this way for excitation of plosives, such as when the letters p, t, or k are pronounced.

Some speech sounds are made from a mixture of two or three of these excitation types (such as /b/, /d/, /g/, and /z/).

The path the airflow takes and the degree to which it is impeded by vocal tract constrictions is defined as the Manner of Articulation.

To produce the different speech sounds from each of the above listed excitation types, the broadband excitation signals are filtered by the vocal tract. For example, the acoustic difference among the plosives p, t and k are due to the different places in the vocal tract where the constrictions are made:

the constriction for /p/ is at the lips.

the constriction for /t/ is at the teeth.

the constriction for /k/ is in the back of the mouth.

In short, the frequency response of the vocal tract depends upon the positions of the tongue, the lips and other articulatory organs. We can thus conclude that the manner of articulation and the voicing, partitions English language (and most language) phonemes into broad phonetic categories. It is the place of articulation (point of narrowest vocal tract constriction) that enables finer discrimination of phonemes. See D. O'Shaughnessy, Speech Communication: Human and Machine, Addison-Wesley Publishing Company, Reading, Mass., 1987.

Many vocoders are based on the source-filter speech model. This model suggests that speech can be generated by modeling the vocal tract as a slowly varying linear filter, and exciting it by either glottal pulses (modeled as a periodic signal) or turbulence (modeled as white Gaussian noise). Similarities can certainly be seen between the source-filter model and actual speech articulation. The excitation source is the stream of air blown through the vocal tract, and the vocal tract is the linear filter.

It is well established that the human auditory system performs a short-time frequency transform on acoustic signals prior to neural transduction and perception. Exact preservation of time waveform is not necessary for perceptually-accurate signal representation which in turn allows the use of vocoders.

The term vocoder was derived from the words VOice CODER. The vocoder was conceived for efficient transmission of speech signals over long and expensive telephone circuits. Vocoders are used today to compress the bandwidth of a speech signal (usually for encrypted digital transmission over telephone bandwidths), but vocoders have evolved and have become more efficient over the years. In vocoders, speech signals can be transmitted over a fraction of the physical bandwidth occupied by the signal if proper coding methods are used. See H. Dudley, The Vocoder, Bell Labs Record, 17:122–126, 1939; and M. R. Schroeder, Vocoders: Analysis and Synthesis of Speech, Proceedings of the IEEE, 54-5:720–734, May, 1966. See H. Dudley, The Vocoder, Bell Labs Record, 17:122–126, 1939; and M. R. Schroeder, Vocoders: Analysis and Synthesis of Speech, Proceedings of the IEEE, 54-5:720–734, May, 1966. The fact that increased economy can be achieved with a vocoder implied that much of the actual speech signal is redundant.

Although early vocoders produced unnatural sounding speech signals, modern vocoders can sound surprisingly natural and in some cases give insight into speech enhancement methods. This is mainly because modern day vocoders have incorporated many of the properties of the acoustic theory of speech production. That is, these vocoders utilize the properties of the vocal tract to analyze, synthesize, and even enhance speech. Speech enhancement is the process of making speech sound perceptually better, which is often performed by reducing noise in the speech signal. Perceptually better cannot be defined explicitly, a consensus must determine this through listening tests.

Efficient vocoders are useful for many speech processing techniques, like data compression for transmission and storage, speech enhancement techniques, and for secure transmission of speech signals. High speech intelligibility is possible at much lower bit rates than would be with direct coding of the speech waveform (64 kbits/sec is the coding rate of standard $\mu$law coding used in present day telephony). Vocoders can also offer a useful transformation into the frequency domain. Manipulation of the data in this domain could be performed to achieve many speech processing functions, such as a speaker transformation (changing one person's voice to sound like another), speech enhancement, or time scale modification of speech (changing the rate, possibly non-linearly, of speech without significantly degrading the perceived signal quality).

Presently, success has been achieved by coding speech with formant vocoders, LPC (linear prediction) vocoders, homomorphic vocoders, channel vocoders, and CELP (code excited linear production) vocoders. In all of these vocoders, speech is modeled as overlapping time segments, each of which is the response of a linear system excited by an excitation signal usually made up of either a periodic impulse train (or modified to more resemble a glottal pulse train), or random noise, or a combination of the two. For each time segment of speech, the excitation parameters, and the parameters of the linear system are determined, and then used to synthesize the speech when needed.

In channel vocoders, the perceptual speech coder will use sub-band coding, the process of breaking up the frequency spectrum into many channels and coding the output of these channels. Channel vocoders analyze the speech in the frequency domain by estimating the energy of speech in discrete frequency bands (channels) over the continuous range of frequencies below the Nyquist sampling rate. The excitation is then classified for each time segment (window) of speech as either voiced or unvoiced, and synthesized accordingly in reconstruction. The quantization of the output parameters (magnitude signals, voiced/unvoiced signals, and pitch signals) of the channel vocoder are done in two parts. The quantization techniques for the excitation parameters and the channel parameters are often performed with different methods. For segments labeled unvoiced, the excitation can be coded with only 1 bit, and regenerated as random white noise. For voiced segments, not only must a bit be spent to declare the excitation voiced, but we must also spend 9–10 bits quantizing the period of the excitation (the pitch). See Flanagan, supra, and D. W. Griffin, the Multi-Band Excitation Vocoder, Ph.D. Dissertation: Massachusetts Institute of Technology, February, 1987. This is often done with simple linear quantization. The complex magnitudes of each frequency band must also be coded. This is called sub-band coding. Adaptive Differential Pulse Code modulation (ADPCM) techniques are the most efficient in coding the output amplitude of each channel. See L. R. Rabiner and R. W. Schafer, Digital Processing of Speech signals, Prentice-Hall, Inc., Englewood Cliffs, N.J., 1978. Each channel is coded with 6–10 bits/segment depending on the desired quality and allowable bit rate of the vocoder. The number of channels is another parameter of the channel vocoder that represents a trade-off between bit rate and synthesized speech quality.

The energy in each of the bands are added to get the synthesized speech signal. The bit containing voicing classification information (voiced or unvoiced) determines the source for each of the magnitudes. The phase and amplitude of the source in each of the bands is controlled by the complex magnitudes. The phase information can be left out to save on bandwidth, but the output speech becomes choppy and mechanical. For natural sounding speech, it is important to code phase information. See J. P. Carlson, Digitalized Phase Vocoder, Proc. Conf. on Speech Comm. and Proc., November, 1987.

It was noticed that the adjacent samples of outputs of each channel in the channel vocoder were highly correlated. ADPCM coders are often used for the output of these coders. See P. Cummiskey, N. S. Jayant, and J. L. Flanagan, Adaptive Quantization in Differential PCM Coding of Speech, The Bell System Technical Journal, 52-7:1105–1118, September, 1973. Other methods were also attempted to reduce the bit rates of the channel vocoders without significant perceptual degradation of the speech signal. One method that is worth discussing was the peak picking approach. To reduce the number of channels to be transmitted, only those channel signals that are greater than their neighbors were transmitted. See E. Peterson and F. S. Cooper, Peakpicker: A Bandwidth Compression Device, J. Acoust. Soc. Am, JASA-29:777–782, June, 1957. They transmitted about ⅓ of the output samples of the channel vocoder, but only reduced the bit rate by about 30 percent due to the need to transmit side information to determine which channels information was transmitted, and which of them were zeroed out.

For many speech sounds there are several prominent maxima in the spectral envelopes. These represent the resonances of the vocal tract and are called formants. It is characteristic of adult speech to have three formants in the frequency range below 3 kHz.

An LPC vocoder is a vocoder where the spectral envelope is obtained using Linear Prediction Coding on the speech segment. LPC analysis evaluates the input speech segment and yields the impulse response of the vocal tract. Either the formant location and amplitudes are extracted from the LPC coefficients or the filter taps (or a form of them like reflection coefficients) are transmitted instead.

Linear Predictive analysis is based on the basic all pole filter:

$$H(z) = \frac{1}{A(z)} \text{ where } A(z) = 1 + \sum_{k=1}^{p} a(k)z^{-k}$$

where $\{a(k), 1 \leqq k \leqq p\}$ are the filter taps or (as will be shown) the predictor coefficients, the residual e(n) is then given by:

$$e(n) = s(n) - \sum_{k=1}^{p} a(k)s(n-k)$$

This equation can be transformed into a synthesis equation by re-writing it as:

$$s(n) = \sum_{k=1}^{p} a(k)s(n-k) + e(n)$$

If we define s(n) as the predicted value of s(n) from a linear combination of the previous p samples scaled by the predictor coefficients:

$$\bar{s}(n) = \sum_{k=1}^{p} a(k)s(n-k)$$

then the excitation can be viewed as the prediction error.

$$e(n) = s(n) - \bar{s}(n)$$

The major problem in using e(n) as the excitation signal in practice is the large number of bits required to transmit it. See G. Bristow, Electronic Speech Synthesis, McGraw Hill, New York, N.Y., 1984. For example, at a sampling rate of 10 kHz, if one quantized each sample to only 4 bits, the required storage would be 40 Kbits/s, which for various applications would be prohibitive. A great deal of effort has been done to reduce the coding requirements of the excitation signal, to make LPC based coding useful for numerous applications.

The predictor coefficients a(k) are calculated as the result of a minimization of the energy in the residual signal e(n) for each frame of speech. The residual energy is given by:

$$E = \sum_{n=-\infty}^{\infty} e_s^2(n) = \sum_{n=-\infty}^{\infty} \left[ s(n) - \sum_{k-1}^{p} a(k)s(n-k) \right]^2$$

where $e_s(n)$ is the residual corresponding to the windowed signal s(n). The predictor coefficients a(k) are calculated by minimizing E with respect to each of the predicting coefficients. The resulting normal equation (which minimizes E) are:

$$\sum_{k=1}^{p} a(k)R(i-k) = -R(i),\ 1 \leq i \leq p$$

and $$R(i) = \sum_{n=-\infty}^{\infty} s(n)s(n-i) = \sum_{n=i}^{N-1} s(n)s(n-i),\ 0 \leq i \leq p$$

This method for obtaining the predictor coefficients is often called the autocorrelation method because the coefficients R(i–k) are the autocorrelation coefficients of the signal.

Although the LPC vocoder is able to code speech at low bit rates, the speech quality leaves more to be desired. Inverse filtering each speech segment with the calculated impulse response yields a residual signal. If the residual signal were used as the excitation of the filter, the output would be identical to the original windowed speech segment. If the excitation could closely resemble the residual, then the resulting speech signal would yield better speech quality. The innovation of the CELP coder is to have prearranged excitations available and to use the excitation that best matches the residual signal. See J. L. Flanagan, M. R. Schroeder, B. S. Atal, R. E. Crochiere, N. S. Jayant, and J. M. Tribolet, Speech Coding, IEEE Trans. Commun., COMM-27:710–737, 1979; B. S. Atal and J. R. Remde, A New Model of LPC Excitation for Producing Natural-Sounding Speech at Low Bit Rates, IEEE Int. Conf. on Acoust. Sp. and Sig. Proc., pages 614–617, April 1982. Each of the excitations have a codeword word associated with it, and only the codeword (and possibly a pitch) need to be transmitted for reconstruction of the residual.

The Multi-band Excitation vocoder entails a different innovation to better model the excitation, and introduces a novel adaptation to the characterization of the vocal tract. The fact that a periodic sequence of excitation impulses will be transformed into a periodic sequence of impulses in the frequency domain (with energy only at the harmonics of the fundamental frequency) leads to the insight that most of the energy in a voiced speech signal will lie at harmonics of the fundamental frequency. One particular type of MBE vocoder is a channel vocoder that has all channels centered at harmonics of the pitch frequency. See D. W. Griffin and J. S. Lim, A New Model-Based Speech Analysis/Synthesis System, IEEE Int. Conf. On Acoustics, Speech, and Signal Processing, pages 513–516, March, 1985; D. W. Griffin and J. S. Lim, Multiband Excitation Vocoder, IEEE Transactions on Acoustics, Speech, and Signal Processing, Vol. 36 No. 8, August, 1980. Griffin also noticed that many speech segments are not purely voiced or unvoiced, and thus a single Voiced/Unvoiced (V/UV) decision per frame is not sufficient. His model has a separate V/UV decision for each channel in each time segment of speech. This allows a better representation of the excitation signal than single V/UV decision vocoders.

With respect to the analysis portion of the MBE vocoder, an accurate estimation of the fundamental frequency track is essential for good speech reproduction. The pitch frequencies are determined by the following three part process: (1) using an algorithmically efficient autocorrelation method, in which a rough pitch period vs. error calculation is made for the integer values within an allowable range of pitch periods; (2) dynamic programming is used to smooth the rough fundamental frequency track from the error calculations with the restriction that the pitch track must change "slowly" on a frame by frame basis (3) and the pitch period is then refined to obtain a pitch track that is much better than integer sample multiples.

From the estimated spectral envelope of the speech, the energy level of the excitation of the spectrum is estimated as if excited by a purely voiced excitation in each subband. The procedure is repeated for unvoiced excitation. The subbands are chosen to be centered at harmonics of the pitch frequency with one sub-band per harmonic. The frequency bins are then classified as either voiced or unvoiced excitation. This is done by computing the error in fitting the original speech to a periodic signal of the pitch frequency in each bin. If the match is good, the error will be low, and the frequency bin will be considered voiced. If the match is poor, a high error level win be detected for that bin, and it will be marked unvoiced.

In the speech synthesis portion of the MBE vocoder, the information containing the spectral envelope is separated into voiced and unvoiced sections as dictated by the V/UV bits. The voiced segments will contain phase and magnitude information, while the unvoiced segments will only contain magnitude information. Voiced speech is then synthesized from the voiced envelope samples by summing sinusoids at frequencies of the harmonics of the fundamental frequency, using magnitude and phase dictated by the voiced envelope information. Unvoiced speech is synthesized from the unvoiced portion of the magnitude stream. The Short Time Fourier Transform (STFT) of broad band white noise is amplitude scaled (a different amplitude per channel) so as to resemble the spectral shape of the unvoiced portion of each frame of speech. An inverse frequency transform is then applied, each segment is windowed, and then the overlap add method is used to assemble the synthetic unvoiced speech. The voiced and unvoiced speech are then added to produce the synthesized speech.

Certain vocoders exhibit a "buzzy" characteristic in the quality of the reproduced speech signal, mainly because some regions of the short time spectra of speech are dominated by harmonics of the fundamental frequency, while other regions are dominated by noise-like energy. Since purely voiced or unvoiced excitations cannot reconstruct such a short time spectra, the quality of the reconstructed speech is degraded. This degradation manifests itself in the reconstructed speech signal as the aforementioned "buzzy" quality.

SUMMARY OF THE INVENTION

A goal of the present invention is to provide a vocoder that improves the quality of reconstructed speech and that achieves a lower bit rate coding and decoding. This improvement is based in part on the realization that a correlation exists between the excitations and spectral weights that are used to characterize speech segments in general.

The vocoder of the present invention comprises an analyzer portion and a synthesizer portion. According to the present invention, the analyzer portion represents each incoming frame of speech as a set of predetermined digital information, and the synthesizer portion reconstructs each frame of speech by decoding this set of predetermined digital information.

According to a first representative embodiment, the analyzer portion includes a spectral weight calculator for calculating a set of spectral weights for an input speech frame. As used herein, the term "spectral weight" is synonymous with the term "spectral magnitude." A target excitation calculator provided in the analyzer portion determines a target set of excitation information, also referred to as a target excitation, in response to the input speech frame. The analyzer portion also determines a set of filter coefficients in response to the same speech frame and a finite impulse response filter model in response to the filter coefficients, which are recursively calculated by sequentially applying each of a plurality of candidate sets of excitation information stored in a table to the finite impulse response filter to determine the error value between the response of the finite impulse response filter to each of the excitation candidate sets and the target excitation set.

The term "candidate set of excitation information" is also referred to as "candidate excitation" and it refers to an excitation derived from an exemplary frame of speech. An exemplary speech frame is a sampling of a person's voice that is stored in the vocoder before any real-time speech processing occurs. The present invention stores a plurality of such exemplary speech frames (and associated candidate excitations). These exemplary speech frames are drawn from a pool of persons. The candidate excitation selected by the present invention for reconstructing the input frame of speech at the synthesizer portion corresponds to the candidate excitation that best approximates the input frame of speech. This selection is determined by selecting the candidate excitation that had the smallest error value for reproducing the input speech frame. The information representing the location of the selected candidate excitation is supplied to a spectral weight correlator, which generates a variable length index code that identifies the selected candidate excitation.

The spectral weight correlator stores a plurality of pregenerated exemplary speech frames and a plurality of associated candidate excitations, each one of which is derived from a corresponding exemplary speech frame. The correlator stores the exemplary speech frames in the form of a K dimensional map, in which each exemplary speech frame is represented as a point in this map. The number of dimensions K corresponds to the number of spectral weights that is generated for each exemplary speech frame. This number is constant, and it matches the number of spectral weights generated for each input speech frame. The plurality of mapped speech frames are subdivided into a plurality of clusters, which represents certain regions of K-dimensional space into which the points representing the exemplary speech frames congregate.

As stated before, each exemplary speech frame is associated with a corresponding candidate excitation. Therefore, a consequence of subdividing the exemplary speech frames into a plurality of clusters is that the candidate excitations corresponding to the exemplary speech frames are also subdivided into the same clusters as the exemplary speech frames. For example, if exemplary speech frames 1 through 5 are grouped into cluster 1; then the candidate excitations associated with exemplary speech frames 1 through 5 are also grouped into cluster 1.

As stated before, the vocoder of the present invention selects a candidate excitation to represent an input frame of speech. The spectral weight correlator determines which cluster includes the exemplary speech frame corresponding to the selected candidate excitation. In generating the variable length index code to identify the selected candidate excitation, the spectral weight correlator determines the total amount of candidate excitations grouped within the cluster; spectral weight correlator then generates a code the data length of which is the minimum data length necessary to uniquely identify each candidate excitation within the cluster, including the selected candidate excitation. For example, if a cluster contains eight exemplary speech frames, a three-bit variable length code would be the code with the minimum data length necessary to identify each associated candidate excitation.

The analyzer portion supplies the synthesizer portion with the spectral weights, the variable length index code, the LPC coefficients, and associated scaling information. The analyzer portion does not supply the synthesizer with the actual selected candidate excitation because the synthesizer uses the spectral weights and the index code to obtain the selected candidate excitation set from the synthesizer's own spectral weight correlator, which stores the same information as the spectral weight correlator of the analyzer portion. After obtaining the selected candidate excitation, the synthesizer portion supplies this information, along with the received LPC coefficients, to an LPC filter. The LPC filter than reconstructs the input frame of speech corresponding to the received LPC coefficients and selected candidate excitation.

According to another representative embodiment of the present invention, an analyzer portion of a vocoder includes a spectral envelope generator for producing a plurality of spectral weights corresponding to an input speech frame. A pitch frequency calculator calculates a fundamental frequency for the input frame of speech. As used herein, the terms "pitch frequency" and "fundamental frequency" are synonymous. An in-band calculator then arranges the spectral weights of the input speech frame to be evenly spaced apart in the frequency domain. The distance, expressed in hertz, between consecutive spectral weights produced by the in-band calculation is equal to the fundamental frequency.

An interpolator/decimator provider in the analyzer portion either reduces or increases the number of spectral weights to a fixed number of spectral weights. A codebook stores a plurality of exemplary speech frames and associated candidate excitations in the same manner as the spectral weight correlator of the previous embodiment. An excitation searcher selects from this codebook the candidate excitation that most accurately represents the input frame of speech. The searcher generates a variable length index code to identify the selected candidate excitation.

At the synthesizer portion of this embodiment, the spectral weights determined by the in-band generator are supplied to another interpolator/decimator, which performs the same function as the one found in the analyzer portion. The synthesizer portion is also provided with an excitation searcher coupled to a codebook that includes the same information as the codebook of the analyzer portion. After reducing or increasing the number of spectral weights to the fixed number of spectral weights, the interpolator/decimator supplies the transformed spectral weights to the searcher provided in the synthesizer. The searcher selects the cluster closest to the current frame of speech on the basis of the spectral weights provided by the interpolator/decimator of the synthesizer portion. The searcher then uses the variable length index code to obtain from within the selected cluster the candidate excitation identified by the variable length index code. The synthesizer then reconstructs the input frame of speech on the basis of the obtained candidate excitation.

BRIEF DESCRIPTION OF THE DRAWINGS

Other features and advantages of the present invention will become apparent from the following detailed description, together with the drawings, in which.

DETAILED DESCRIPTION

Figure 1:
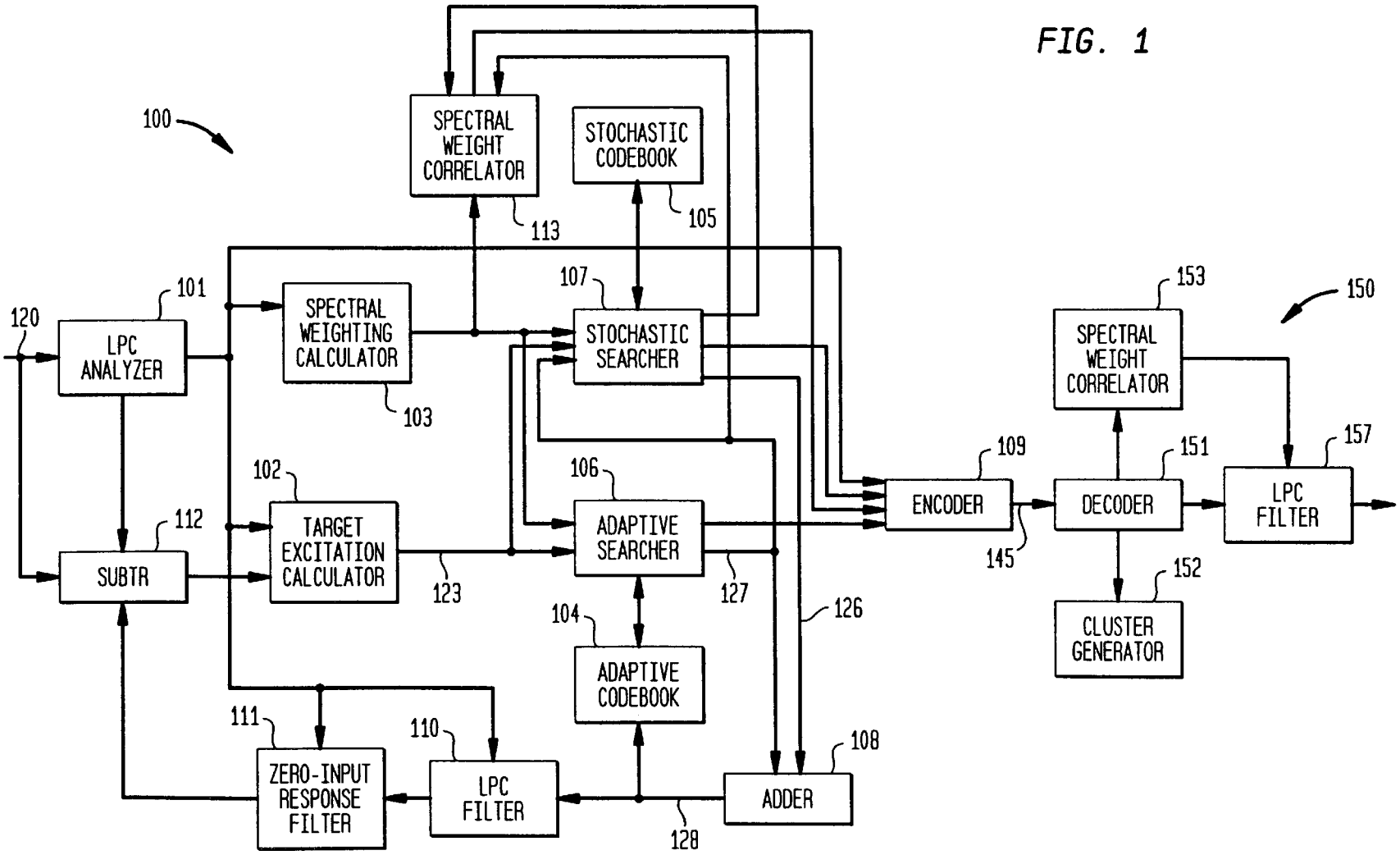
FIG. 1 illustrates a vocoder according to a first embodiment of the present invention.

FIG. 1 illustrates, in block diagram form, a vocoder according to a representative embodiment of the present invention. The vocoder of FIG. 1 of the present application is based in part on the CELP (Code Excited Linear predictive) vocoder in FIG. 1 of U.S. Pat. No. 4,899,385, the specification of which is incorporated by reference herein. Elements 101 through 113 represent the analyzer portion of the vocoder, whereas, elements 151 through 157 represent the synthesizer portion 100 of the vocoder. The analyzer portion 150 of FIG. 1 is responsive to incoming speech received on path 120 to digitally sample the analog speech into digital samples and to group those digital samples into frames using well-known techniques. For each frame, the analyzer portion calculates the LPC coefficients representing the formant characteristics of the vocal tract and searches for entries from both the stochastic codebook 105 and adaptive codebook 104 that best approximate the speech for that frame along with scaling factors. The latter entries and scaling information define excitation information as determined by the analyzer portion. The spectral weights calculated by spectral weighting calculator 103 and the LPC coefficients, along with a variable length index code indicative of the defined excitation information, are transmitted to the synthesizer portion of the vocoder illustrated in FIG. 1.

At the synthesizer portion of the vocoder, the variable length length code is used to access from memory the candidate excitation selected by the analyzer portion. This accessed excitation information is used to excite an LPC filter 157 in order to reconstruct the frame of speech originally supplied to the analyzer portion of the vocoder.

Consider now in greater detail the functions of the analyzer portion of FIG. 1. LPC analyzer 101 is responsive to the input speech frame to determine LPC coefficients using well-known techniques. These LPC coefficients are transmitted to target excitation calculator 102, spectral weighting calculator 103, encoder 109, LPC filter 110, and zero-input response filter 111. Spectral weighting calculator 103 is responsive to the coefficients to calculate spectral weighting information in the form of a matrix that emphasizes those portions of speech that are known to have important speech content. This spectral weighting information is reformed to as the spectral weights corresponding to the input speech frame, and these spectral weights are based on a finite impulse response LPC filter. The utilization of a finite impulse response filter will be shown to greatly reduce the number of calculations necessary for performing the computations performed in adaptive searcher 106 and stochastic searcher 107. These spectral weights are utilized by searchers 106 and 107 in order to determine the best candidate for the excitation information from adaptive codebook 104 and stochastic codebook 105.

Target excitation calculator 102 calculates the target excitation which adaptive searcher 106 and stochastic searcher 107 attempt to approximate. This target excitation is calculated by convolving a whitening filter based on the LPC coefficients calculated by LPC analyzer 101 with the incoming speech minus the effects of the excitation and LPC filter for the previous frame. The latter effects for the previous frames are calculated by LPC filter 110 and zero-input response filter 111. The reason that the excitation and LPC filter for the previous frame must be considered is that these factors produce a signal component in the present frame which is often referred to as the ringing of the LPC filter. LPC filter 110 and zero-input response filter 111 are responsive to the LPC coefficients and calculated excitation from the previous frame to determine this ringing signal and to transmit it via path 144 to subtracter 112. Target excitation calculator 102 is responsive to the remainder signal produced by subtracter 112 to calculate the target excitation information and transmit the latter information via path 123 to adaptive searcher 106 and stochastic searcher 107.

Adaptive searcher 106 and stochastic searcher 107 work sequentially to determine the calculated excitation, which is also referred to as a candidate excitation. Each searcher calculates a portion of the candidate excitation. First, adaptive searcher 106 calculates excitation information and transmits this via path 127 to stochastic searcher 107. Stochastic searcher 107 is responsive to the target excitation received via path 123 and the excitation information from adaptive searcher 106 to calculate the remaining portion of the calculated excitation that best approximates the target excitation calculated by target excitation calculator 102. Stochastic searcher 107 determines the remaining excitation to be calculated by subtracting the excitation determined by adaptive searcher 106 from the target excitation. The candidate excitation determined by adaptive searcher 106 and stochastic searcher 107 is transmitted via paths 127 and 126, respectively, to adder 108. Adder 108 adds the two excitation components together to arrive at the candidate excitation for the present frame. As will be explained later, spectral weight correlator 113 uses this candidate excitation to generate the aforementioned variable length index code.

The output of adder 108 is also transmitted via path 128 to LPC filter 110 and adaptive codebook 104. The excitation information transmitted via path 128 is utilized to update adaptive codebook 104. The codebook indices and scaling factors are transmitted from adaptive searcher 106 and stochastic searcher 107 to spectral weight correlator 113.

Adaptive searcher 106 functions by accessing sets of excitation information stored in adaptive codebook 104 and utilizing each set of information to minimize an error criterion between the target excitation received via path 123 and the accessed set of excitation from adaptive codebook 104. A scaling factor is also calculated for each accessed set of information since the information stored in adaptive codebook 104 does not allow for the changes in dynamic range of human speech.

The error criterion used is the square of the difference between the original and synthetic speech. The synthetic speech is that which will be reproduced in the synthesizer portion of FIG. 1 on the output of LPC filter 157. The synthetic speech is calculated in terms of the synthetic excitation information obtained from adaptive codebook 104 and the ringing signal; the speech signal is calculated from the target excitation and the ringing signal. The excitation information for synthetic speech is utilized by performing a convolution of the LPC filter as determined by LPC analyzer 101 utilizing the weighting information from spectral weighting calculator 103 expressed as a matrix. The error criterion is evaluated for each set of information obtained from adaptive codebook 104, and the set of excitation information giving the lowest error value is the set of information utilized for the present frame.

After adaptive searcher 106 has determined the set of excitation information to be utilized along with the scaling factor, the index into adaptive codebook 104 and the scaling factor are transmitted to stochastic searcher 107. Stochastic searcher 107 subtracts the excitation information from adaptive searcher 106 from the target excitation received via path 123. Stochastic searcher 107 then performs operations similar to those performed by adaptive searcher 106.

The excitation information in adaptive codebook 104 is excitation information from previous frames. For each frame, the excitation information consists of the same number of samples as the sampled original speech. Advantageously, the excitation information may consist of 55 samples for a 4.8 Kbps transmission rate. Adaptive codebook 104 is organized as a push down list so that the new set of samples is simply pushed into adaptive codebook 104, thus replacing the earliest samples presently in adaptive codebook 104. When utilizing sets of excitation information out of adaptive codebook 104, adaptive searcher 106 does not treat these sets of information as disjoint sets of samples but rather treats the samples in adaptive codebook 104 as a linear array of excitation samples. For example, adaptive searcher 106 will form the first candidate set of information by utilizing sample 1 through sample 55 from adaptive codebook 104, and the second set of candidate information by using sample 2 through sample 56 from adaptive codebook 104. This type of searching a codebook is often referred to as an overlapping codebook.

As this linear searching technique approaches the end of the samples in adaptive codebook 104, there is no longer a full set of information to be utilized. A set of information is also referred to as an excitation vector. At that point, adaptive searcher 106 performs a virtual search. A virtual search involves repeating accessed information from the table into a later portion of the set for which there are no samples in the table. This virtual search technique allows adaptive searcher 106 to more quickly react to transitions from an unvoiced region of speech to a voiced region of speech. The reason is that in unvoiced speech regions the excitation is similar to white noise whereas in the voiced regions there is a fundamental frequency. Once a portion of the fundamental frequency has been identified from the codebooks, it is repeated.

Figure 2:
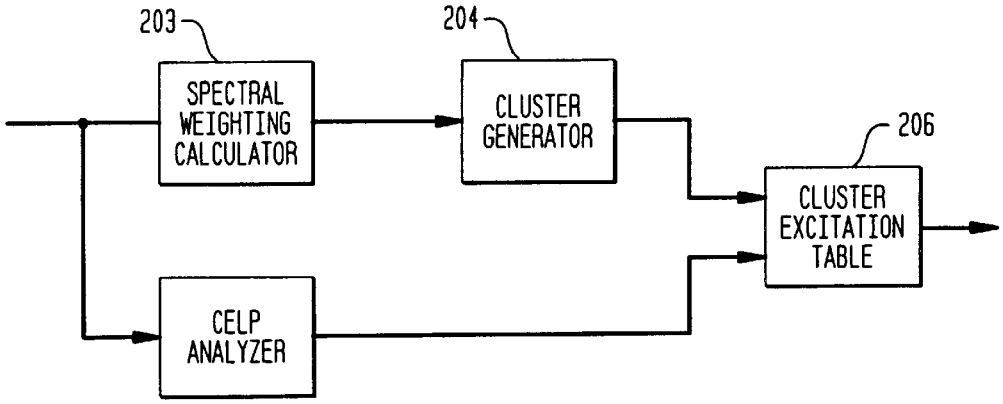
FIG. 2 illustrates an apparatus for generating the information stored in the spectral weight correlator 113 of FIG. 1.

Before the operation of spectral weight correlator 113 is discussed, it is necessary to explain how the information stored in correlator 113 is generated. This information is generated and stored in correlator 113 before the apparatus of FIG. 1 analyzes or synthesizes real-time speech. FIG. 2 illustrates a system that generates the information stored in correlator 113. The system of FIG. 2 (1) arranges a predetermined number of exemplary speech frames into various clusters according to a predetermined clustering algorithm and (2) associates these clusters with the candidate excitations corresponding to these exemplary speech frames. The spectral weight correlator 113 stores a mapping of the various clusters arranged by the system of FIG. 2, and correlator 113 also stores each of the candidate excitations corresponding to the exemplary speech frames.

As used herein, the term "exemplary speech frame" refers to a speech frame that serves as a baseline for comparison to an input speech frame that is to be processed by the apparatus of FIG. 1, the goal of such a comparison being to determine which exemplary speech frame (and associated candidate excitation) most accurately represents the input speech frame. These exemplary speech frames may be generated by a plurality of persons whose voices have been recorded and digitized. A candidate excitation is derived for each of this speech frame. In this embodiment, the candidate excitation sets associated with these exemplary speech frames are the same excitations that are derived from stochastic codebook 105 and adaptive codebook 104. For example, for the pronunciation of the letter "E" (or any other letter or human-generated sound), a plurality of different speech frames covering slightly different pronunciations of the letter "E" may be supplied to the clustering system of FIG. 2. The candidate excitations associated with these exemplary speech frames for the letter "E" would be compared to real-time speech frames that may closely match one or more of these exemplary speech frames. The correlator 113 then generates a variable length index code having the minimum data length necessary to identify the selected candidate excitation that most closely matches the particular input speech frame being analyzed. As shall be explained later, the minimum number of bits needed to identify a candidate excitation depends on the number of excitations belong to the cluster that includes the selected candidate excitation.

Figure 3:
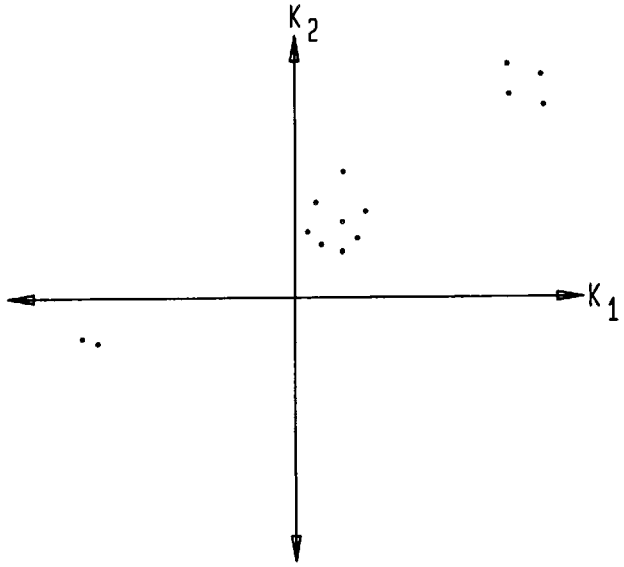
FIG. 3 illustrates a two-dimensional mapping of a plurality of speech frames.
Figure 4:
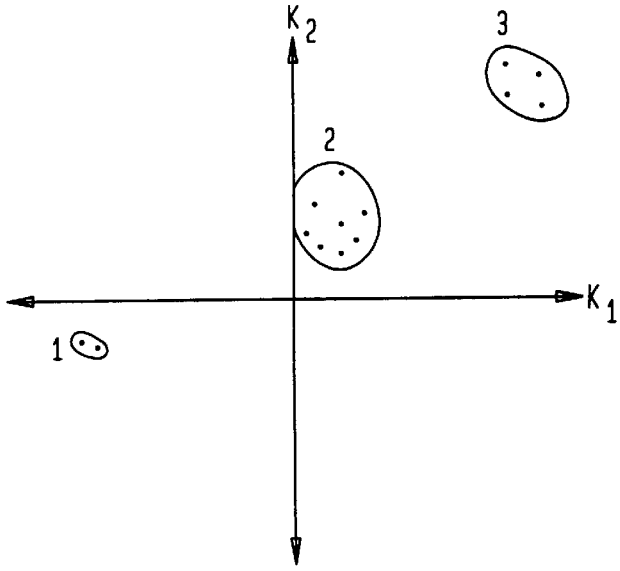
FIG. 4 illustrates the grouping into clusters of the speech frames mapped in FIG. 3.

These exemplary speech frames discussed above are individually supplied to spectral weight calculator 203, which generates for each speech frame the same number of spectral weights. Spectral weight calculator 203 operates in the same manner as spectral weight calculator 103 of FIG. 1. The desired number of spectral weights generated for each speech frame is arbitrarily set, and it may depend on such factors as cost of construction or desired speech quality. The various spectral weights generated for each speech frame may be viewed as coordinates that represent the position of the corresponding speech frame in K-dimensional space. Thus, for example, if eight spectral weights are generated for each speech frame, then each speech frame is mapped onto eight dimensional space in accordance with the speech frame's corresponding spectral weight values. FIG. 3 illustrates this concept of spectral weight mapping, where for the sake of simplicity the number of spectral weights per speech frame has been selected to be two. Generating two spectral weights for each speech frame may produce, for example, the two-dimensional graph of FIG. 3. Each spectral weight value corresponds to a coordinate position along one or the other axes $K_1$ or $K_2$. Thus, each point on the graph of FIG. 3 represents the mapping of a set of spectral weight values corresponding to a particular speech frame. As is evident from this graph, the mapped speech frames tend to "cluster" in certain regions of this 2 dimensional distribution. FIG. 4 illustrates the same speech frame distributions as FIG. 3, but in FIG. 4, each such speech frame has been grouped within a predetermined cluster. Each cluster in FIG. 4 is referred to by a particular numeral. This "clustering" of various speech frames is performed by cluster generator 204 in accordance with well-known clustering techniques. Thus, element 204 assigns each spectral weight set corresponding to an exemplary speech frame to a particular cluster.

Since each exemplary speech frame is associated with a candidate excitation, the mapping of these speech frames is, in effect, a mapping of such excitations as well. As illustrated in FIG. 2, each exemplary speech frame is also supplied to the analyzer portion of the CELP vocoder described in the '385 patent. The CELP analyzer portion of the '385 patent generates for each speech frame a set of target excitation information, and determines from the operation of the stochastic searcher and adaptive searcher the candidate excitation that most closely matches the particular target excitation under analysis. As explained before, the candidate excitation determination performed by the stochastic searcher and the adaptive searcher is based on pre-stored excitation entries indexed in the stochastic codebook and adaptive codebook.

At cluster/excitation table 206, the cluster number associated with an input exemplary speech frame is correlated to the candidate excitation set generated for that particular frame of speech. The contents of cluster/excitation table 206 is pre-stored in spectral weight correlator 113 of FIG. 1 before the apparatus of FIG. 1 is operated under real-time conditions. Thus, each cluster corresponds to a subset, or sub-codebook, of candidate excitations that are associated with respective exemplary speech frames. For example, in FIG. 4, cluster number one is associated with two exemplary speech frames (and their associated excitations).

The operation of spectral weight correlator 113, in conjunction with the analyzer and synthesizer portions of the vocoder of FIG. 1, will now be discussed. For each input speech frame, correlator 113 accepts as inputs the outputs of spectral weighting calculator 103, adaptive searcher 106 and stochastic searcher 107. The outputs of correlator 113 are respectively coupled to adaptive codebook 104 and stochastic codebook 105. As explained before, stochastic searcher 107 and adaptive searcher 106 select a candidate excitation that best approximates the target excitation calculated by target excitation calculator 102, which bases its calculation on an input frame of speech. Correlator 113 then determines what cluster corresponds to the associated candidate excitation. Correlator 113 accomplishes this determination by finding in its stored table the cluster number associated with the determined candidate excitation. By finding the associated cluster, correlator 113 generates a variable length code that identifies the matching excitation within the cluster.

For example, assume that the candidate excitation most closely matching the target excitation belongs to cluster number two, and that cluster number two encompasses eight different excitations, as illustrated in FIG. 4. Since the particular candidate excitation is one of only eight possible excitations associated with cluster number two, only three bits are necessary to uniquely identify the particular candidate excitation within that cluster. Thus, the number of bits needed to identify a candidate excitation depends on the number of excitations grouped within the cluster that is associated with the candidate excitation. If the candidate excitation is found to reside in a cluster of only two excitations, then only one bit is needed to identify the candidate excitation. A cluster encompassing four excitations would require two bits to identify any particular excitation included therein.

Each input speech frame is encoded by the analyzer portion of the present invention as a data packet, which may also be referred to as a speech characterization code. The packet of data is transmitted to the synthesizer portion of the present invention; the synthesizer portion reconstructs the present input speech frame in accordance with the data packet generated for that input speech frame. The data packet may include the spectral weights corresponding to the particular frame of speech, the corresponding LPC coefficients and scaling factors, and the variable length index code described before. The data packet may also include such typical data transmission codes as error correction codes or synchronization codes.

This packet is supplied via path 145 to the decoder 151 of the synthesizer portion. The synthesizer portion includes a second spectral weight correlator 153 that includes the same information stored in correlator 113. The LPC coefficients are supplied by decoder 151 to LPC filter 151. Cluster generator 152 receives the spectral weights corresponding to the speech frame currently being synthesized. Having been supplied with the cluster map of FIG. 4, cluster generator 152 determines which cluster is closest, in K dimensional space, to the input speech frame represented by the received spectral weights. As stated before, each cluster itself encompasses a plurality of the above-mentioned exemplary speech frames, each one of these speech frames corresponding to a candidate excitation set that may be supplied to LPC filter 157 to reconstruct the current speech frame. This determined cluster includes the candidate excitation selected by the analyzer portion.

Once the cluster closest to the current speech frame has been determined, the next step is to determine which one of the multiple candidate excitations sets associated with this cluster shall be supplied to LPC filter 157 to reconstruct the current speech frame. The information needed to select the appropriate excitation set is embodied in the variable length index code supplied by the analyzer portion of FIG. 1.

Since the variable length index code may be of any length, spectral weight correlator 153 must first determine how long this code is. The variable length index code is provided to the synthesizer portion as part of a speech characterization code that includes other codes, such as the LPC coefficients. The first step in determining the length of the index code is to find in the speech characterization code the first bit of the variable length index code. In the present example, assume that the data packet supplied from decoder 151 to correlator 153 first includes a set of synchronization bits followed by the variable length index code. Since the number of sync bits in data transmission packets are typically fixed, correlator 153 would be capable of determining which bit position of the data packet marks the beginning of the variable length index code. As stated before, correlator 153 is supplied by cluster generator 152 with the number of the cluster that includes the excitation that most closely matches the current candidate speech frame. Since correlator 153 also includes information indicating how many excitations are associated with this cluster, the correlator can determine how many bits are included in the current variable index code. For example, assume that the cluster closest to the current speech frame encompasses four different candidate excitations; since only the minimum number of bits is used to identify each of these excitations, it necessarily follows that the variable length index code for this speech frame is two bits longs. The present invention is not limited to this method for determining the data length of the variable length index code; instead, the present invention is compatible with any suitable procedure for extracting a variable length code from a data packet.

After correlator 153 determines the length of the index code, it reads out the value of the variable length index code from the data packet. The value of this code uniquely identifies one of the candidate excitations associated with the cluster closest to the current speech frame. Therefore, based on this value, correlator 153 accesses from memory the candidate excitation identified by the variable length index code. This excitation is then supplied to LPC filter 157. Having been supplied with a candidate excitation and associated LPC coefficients, LPC filter 157 is able to reconstruct the corresponding frame of speech.

The present invention may be applied not only to CELP vocoders, but also to any other vocoder that processes speech by using spectral magnitudes and excitations. Some examples of such vocoders include the Residual Excited Linear predictive (RELP) vocoder, the Self Excited Linear Predictive (SELP)vocoder, and the Multi-Band Excitation (MBE) vocoder.

Figure 5:
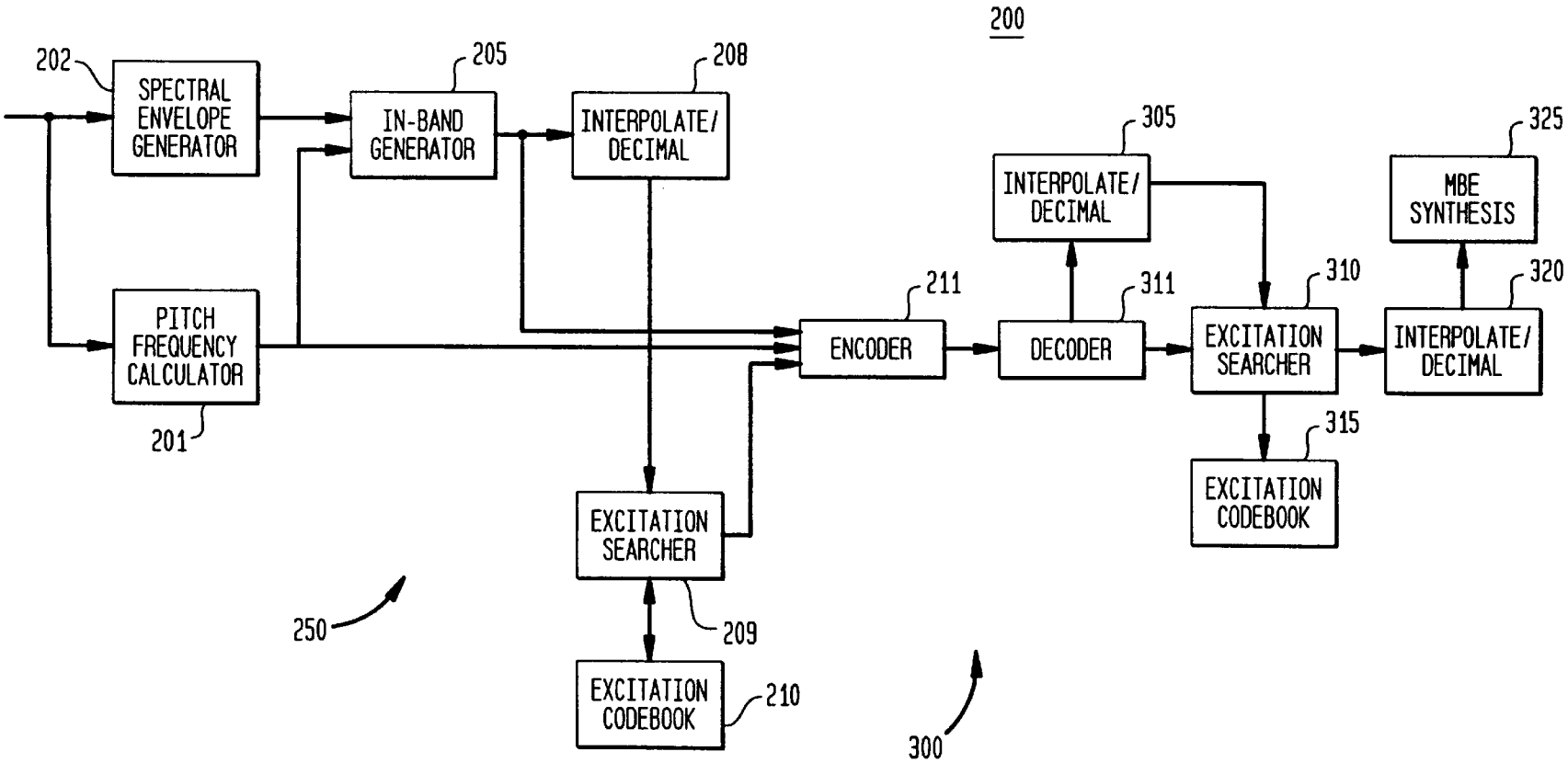
FIG. 5 illustrates a vocoder according to a second embodiment of the present invention.

FIG. 5 illustrates another representative embodiment of the present invention, in which the present invention has been applied to an MBE vocoder. This particular embodiment is designated as a Mixed Excitation a Multiband (MEMB) vocoder 200. The MEMB vocoder comprises an analysis portion 250 and a synthesis portion 300. In the analysis portion 250 of MEMB vocoder 200, an input frame of speech is provided to spectral envelope generator 202 and to pitch frequency calculator 201. Spectral envelope generator 202 determines the spectral magnitudes for each input frame of speech using well-known spectral processing techniques. Pitch frequency calculator 201 determines the fundamental frequency for each input frame of speech in accordance with well-known pitch frequency calculating techniques. The spectral magnitudes are supplied to in-band spectral value generator 205. In-band generator 205 supplies at its output the spectral magnitudes of the input speech frame at harmonics of the fundamental frequency.

Figures 6, 7:
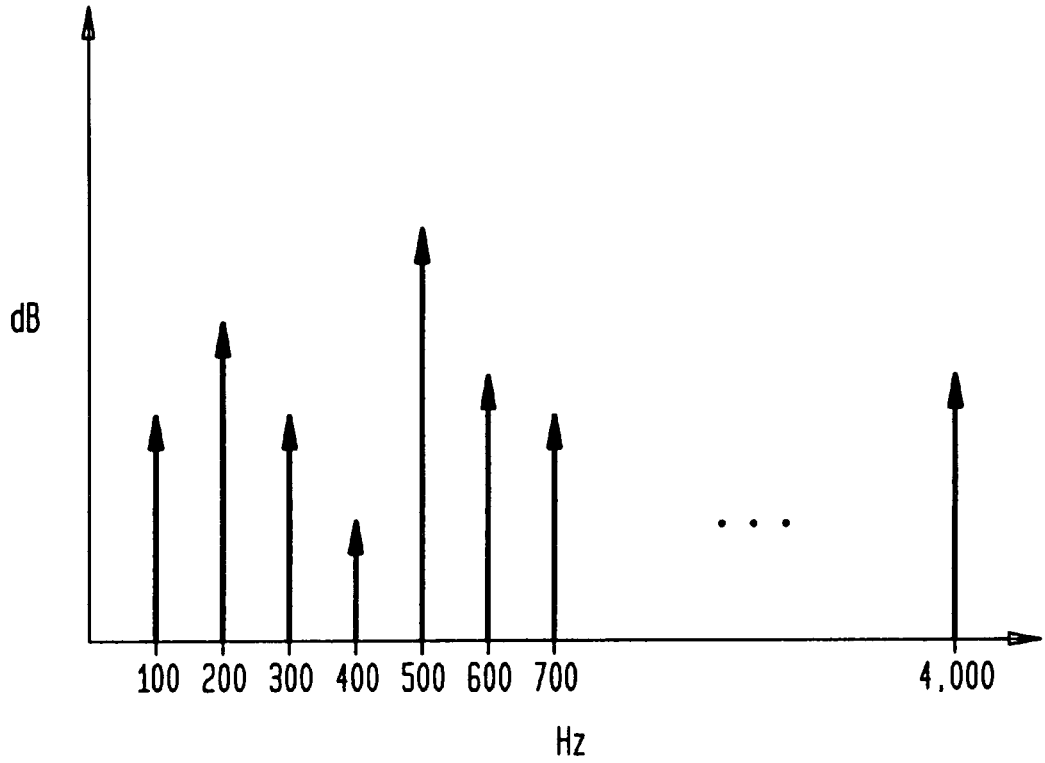
FIG. 6 illustrates a plurality of spectral magnitudes corresponding to an input frame of speech.
FIG. 7 illustrates a table of candidate excitations stored by the vocoder of FIG. 5.

For example, as illustrated in FIG. 6, if the fundamental frequency for an input speech frame is determined to be 100 Hz, then the spectral magnitudes provided by in-band generator 205 are spaced apart by 100 Hz. In the example of FIG. 6, the input speech frame was sampled at a rate of 4,000 Hz. Therefore, since the fundamental frequency for this input speech frame is 100 Hz, in-band generator 205 provides for this input speech frame 40 magnitudes that are spaced apart by 100 Hz. Since the number of spectral magnitudes per frame provided by in-band generator 205 depends on the fundamental frequency of the speech frame, the number of magnitudes per input speech frame provided by in-band generator 205 may vary from frame to frame.

These spectral magnitudes are supplied to interpolator/decimator 208, which either interpolates or decimates the number of spectral magnitudes of an input speech frame to a fixed, predetermined amount of magnitudes. This procedure is performed as a prelude to determining the correlation between the spectral magnitudes of the input speech frame and the candidate excitation that most accurately represents that speech frame. As explained in the previous embodiment, each exemplary frame of speech can be mapped onto a K-dimensional coordinate system. The number of dimensions K is equal to the number of spectral weights generated for the exemplary speech frame. In order to use clustering to determine the correlation between the spectral magnitudes of the input speech frame and a particular candidate excitation that can be used to characterize that speech frame, a constant number of dimensions (i.e., spectral weights) is required. Otherwise, the number of dimensions K would vary every time the number of spectral weights changed from frame to frame; such dynamic variation in the number of dimensions for mapping the frames would prevent the comparison of a current input speech frame to a pre-generated cluster map of exemplary speech frames.

The fixed number of spectral weights produced per frame by interpolator/decimator 208 is set before any real-time speech processing occurs. For example, in the representative embodiment of FIG. 6, the fixed number of spectral weights produced by interpolator/decimator 208 is set at 20. The spectral weights produced by the interpolator/decimator 208 are spaced apart evenly in frequency. If the number of spectral weights produced by in-band generator 205 is greater than this fixed number, then interpolator/decimator 208 decimates, or reduces, this amount of spectral weights down to the fixed number. If the number of spectral weights provided by in-band generator 205 is less than this fixed number, then interpolator/decimator 208 interpolates, or increases, this number up to the fixed number.

After interpolating or decimating the number of spectral magnitudes to a fixed amount, the interpolator/decimator 208 supplies these spectral magnitudes to excitation searcher 209. Excitation searcher 209 selects the candidate excitation most-closely matching the current speech frame by consulting excitation codebook 210. Excitation codebook 210 organizes a plurality of exemplary speech frames into various clusters, as exemplified in FIG. 4. Of course, FIG. 4 is a simplification of the clustering technique that would be used in this embodiment because FIG. 4 only deals wit 2 dimensions (i.e., 2 spectral weights per frame). As stated before, the number of spectral weights in the vocoder of FIG. 5 has been fixed at 20; therefore, the clusters in codebook 210 are mapped into 20-dimensional space. The candidate excitations are associated with exemplary speech frames that have been grouped into clusters. These candidate excitations are stored in excitation codebook 210, and they have been pre-generated and pre-stored by sampling and storing voices from a candidate pool of persons.

Based on this mapping of clusters in excitation codebook 210, excitation searcher 209 determines which cluster is closest to the spectral weight set corresponding to the current input speech frame. This determination is based on which cluster has the shortest distance, in K-dimensional dimensional space, to the current input speech frame, which is also mapped onto K-dimensional space after being interpolated or decimated. After determining which cluster is closest to the current speech frame, excitation searcher 209 again consults excitation codebook 210 to determine which candidate excitation within the selected cluster most accurately characterizes the current speech frame.

FIG. 7 illustrates a table of candidate excitations stored in codebook 210. Each column represents a different excitation, and each row illustrates a different frequency band, all of which are evenly spaced apart in frequency. Each frequency band corresponds to the spectral location (i.e., location along a frequency axis) of one of the spectral magnitudes produced by interpolator/decimator 208. Codebook 210 stores a different table of excitations for each cluster. Each table includes those excitations that have been grouped into the associated cluster. The table of FIG. 7 corresponds to the cluster that is closest to the current input speech frame. For the sake of simplicity, the number of bands has been limited to 4, instead of the 20 bands discussed previously. In FIG. 7, the corresponding bands for each candidate excitation have been assigned either a "V", for voiced excitation, or a "U", for unvoiced excitation. For each excitation, a "V", which may be digitally represented as binary "1", signifies that the corresponding band of the excitation is best represented as a voiced signal. This voiced signal can be characterized by a sinusoid. A "U", which may be digitally represented as binary "O", signifies that the corresponding band of the excitation is best represented as an unvoiced signal. This unvoiced signal may be represented by a white noise signal.

The excitation closest to the current speech frame can be determined using typical spectral analysis techniques, such as bit distance analysis, for example. Once searcher 209 has determined which candidate excitation most accurately represents the current speech frame, it represents such an excitation by a variable length index code. For example, if the table of FIG. 7 includes sixteen excitations (meaning that the cluster corresponding to that table groups sixteen excitations), each of these excitations could be assigned a different four bit code. If a table included eight excitations, only three bits would be necessary to identify these excitations. Previous MBE vocoders, which do not include such codebooks, would transmit a bit representing each voiced/unvoiced decision for each candidate excitation. Therefore, if each input speech frame was characterized by forty spectral weights located at forty different, evenly-spaced harmonics, forty bits representing the voiced/unvoiced decisions at each harmonic of the set of spectral weights would need to be transmitted to the synthesizer.

The embodiment of FIG. 5 avoids transmitting this many bits by storing the same excitation information at excitation codebook 210 of the analyzer portion 250 and at excitation codebook 315 of the synthesizer portions 300. Excitation codebook 210 of the analyzer portion 250 and excitation codebook 315 of the synthesizer portion 300 store the same plurality of sets of different combinations of voiced/unvoiced decisions. Each of these different combinations represents a different candidate excitation, and the codebooks group these candidate excitations into the same plurality of clusters. As explained before, analyzer portion 250 selects which cluster is closest to the current input speech frame and then uses a table of excitations corresponding to the selected cluster to determine which excitation grouped within that cluster most accurately represents that input speech frame. Therefore, rather than transmit to synthesis portion 300 each voiced/unvoiced decision of the selected candidate excitation, analyzer 250 can transmit, as explained above, a variable length index code that identifies such a candidate excitation. By employing an excitation codebook 315 that stores the same information as excitation codebook 210, synthesizer 300 does not need to directly receive from analyzer 250 the complete set of voiced/unvoiced decisions necessary to reconstruct the corresponding input speech frame. Instead, synthesizer 300 access from its own excitation codebook 315 this set of voiced/unvoiced decisions by using the received variable length index code to look up in excitation codebook 315 the same candidate excitation that was selected by analyzer portion 250 as most accurately representing the corresponding input speech frame.

At synthesizer 300, the spectral weights provided by in-band generator 206 are supplied to interpolator/decimator 305, which performs on these received spectral weights the same interpolation or decimation as interpolator/decimator 208. The spectral weights provided by interpolator/decimator 305 are supplied to excitation searcher 310, which also receives the variable length index code generated by excitation searcher 209 of the analyzer portion 250. Coupled to excitation searcher 310 is excitation codebook 315, which stores the same cluster mapping and excitation tables as excitation codebook 210. Excitation searcher 310 uses the spectral magnitudes provided by interpolator/decimator 305 to determine which cluster is closest to the current input frame of speech, in the same manner as excitation searcher 209. Excitation searcher 310 then uses the variable length index code provided by excitation searcher 209 to access from excitation codebook 315 the candidate excitation identified by the received variable length index code. As stated before, this candidate excitation has been determined by analyzer portion 250 to most accurately characterize the particular input speech frame being currently synthesized.

Excitation searcher 310 provides this accessed candidate excitation to interpolator/decimator 310, which also receives the spectral weights (spaced apart by the fundamental frequency) generated by in-band generator 206. Interpolator/decimator 320 performs the opposite function performed by interpolator/decimator 305. Thus, instead of decimating or interpolating the number of spectral magnitudes to a fixed amount, interpolator/decimator 320 translates the candidate excitation into a plurality of spectral weights, the amount of which is equal to the amount of spectral weights originally produced by in-band generator 206 for the input speech frame.

Figure 8:
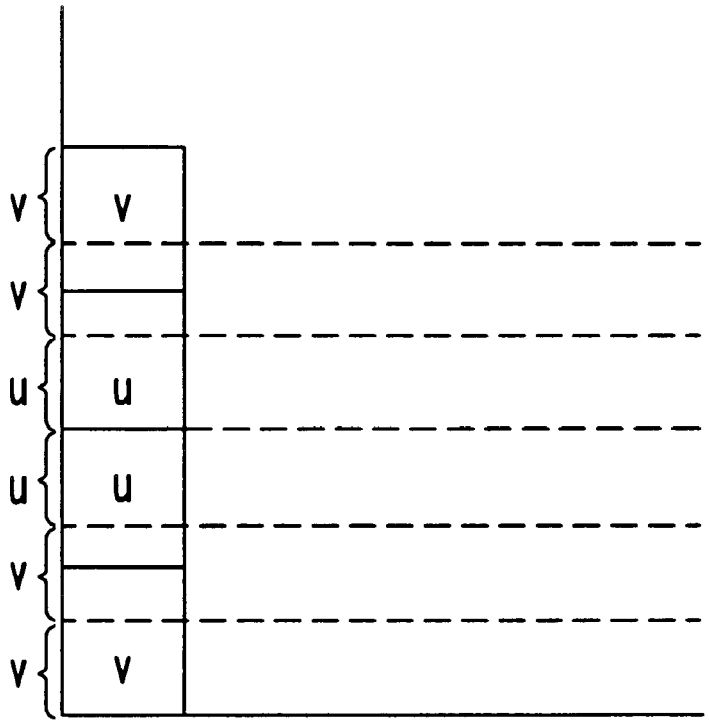
FIG. 8 illustrates a candidate excitation being translated from an excitation that corresponds to a first amount of frequency bands to an excitation that corresponds to a second amount of frequency bands.

For example, in FIG. 8, assume that the spectral weight set corresponding to the input speech frame, as generated by in-band generator 206, was originally decimated from six spectral weights per frame to four spectral weights per frame, because the cluster mapping and excitation tables of excitation codebook 210 have been mapped onto four dimensions. The particular collection of voiced and unvoiced decisions in FIG. 8 represents a candidate excitation selected from excitation codebook 210 (and excitation codebook 315 at synthesizer 300). The purpose of interpolator/decimator 320 is to translate the four voiced/unvoiced decisions of the selected candidate excitation set into six voiced/unvoiced decisions, in order to match the six spectral weights that characterize the current input speech frame.

In order to perform this translation, interpolator/decimator 320 divides the four voiced/unvoiced bands into six bands equally spaced apart in frequency in the same way as the spectral weights of the corresponding input speech frame, as generated by in-band generator 206, are also evenly spaced apart in frequency. These six frequency bands are illustrated in FIG. 8 by the dotted lines. For each of these six bands, interpolator/decimator 320 decides whether to characterize the band as voiced or unvoiced. In doing so, interpolator/decimator 320 determines which original band or bands, as illustrated by the solid lines in FIG. 8, overlap each band defined by the dotted lines. For example, since the first, or bottom, of the six bands lies completely within the area of an original voiced band, this new band is also regarded as voiced. Since the third band of the six dotted regions lies in an original unvoiced band, it will be designated as unvoiced as well. Similarly, since the sixth band, located at the top, lies in an original region designated as voiced, it too will be designated as voiced.

Once this translation is complete, interpolator/decimator 320 provides the translated candidate excitation to a typical MBE synthesis portion 325, which is also supplied with the fundamental frequency and spectral magnitudes of the input speech frame. MBE synthesis portion 325 reconstructs the speech frame by assigning either a sinusoid or a noise signal to each spectral magnitude of the input speech frame and super-positioning the resulting signals of each of the spectral magnitudes. Therefore, if the first magnitude of the input speech frame is at 50 Hz, and the 50 Hz band of the candidate excitation set is voiced, then a sinusoid is applied to that first magnitude. With respect to the spectral magnitude at 100 Hz, if the corresponding frequency band in the candidate excitation is unvoiced, then a noise signal is applied to the spectral magnitude at 100 Hz, and the resulting signal is super positioned to the resulting signal at 50 Hz. This process is continued until a sinusoid or noise signal is applied to all the magnitudes of the input speech frame, and the resulting signals at each frequency band are super positioned in order to reconstruct the input frame of speech originally provided to the analyzer portion 250.

What is claimed is:

1. A method of encoding an input frame of speech based on a plurality of candidate excitations, the plurality of candidate excitations being subdivided into a plurality of subsets, each of the subsets including a predetermined amount of the plurality of candidate excitations, the method comprising the steps of:

a) determining a plurality of spectral weights based on the input frame of speech;

b) determining a target excitation based on the input frame of speech;

c) selecting from the plurality of candidate excitations the candidate excitation most closely matching the target excitation;

d) identifying the selected candidate excitation by a variable length index code having a data length based on the predetermined amount of candidate excitations included in the subset corresponding to the selected candidate excitation;

e) communicating a speech characterization code without communicating the selected candidate excitation, the speech characterization code including at least the variable length index code and the plurality of the spectral weights calculated in step a);

f) receiving the speech characterization code communicated in step e); and g) determining, based on the plurality of spectral weights included in the speech characterization code, the subset of candidate excitations which includes the selected candidate excitation.

2. The method according to claim 1, further comprising the steps of:

h) obtaining the selected candidate excitation from the subset determined in step g) by using the variable length index code; and i) reconstructing the input frame of speech based on the obtained candidate excitation.

3. The method according to claim 1, wherein each one of the plurality of subsets of candidate excitations is associated with a corresponding exemplary speech frame, each exemplary speech frame being mapped onto K-dimensional space, wherein K corresponds to an amount of the plurality of spectral weights determined in step a).

4. The method according to claim 3, wherein the step d) of identifying the selected candidate excitation comprises the steps of:

h) identifying in K-dimensional space a location of the selected candidate excitation;

i) determining from the location of the selected candidate excitation which subset of candidate excitations includes the selected candidate excitation; and j) determining the data length of the variable length code to be the minimum number of bits necessary to uniquely identify each of the candidate excitations grouped within the subset determined in step i).

5. The method according to claim 1, wherein the data length of the variable length index code is determined to be the minimum number of bits necessary to uniquely identify each candidate excitation grouped in the subset including the selected candidate excitation.

6. The method according to claim 1, wherein the step a) of determining the plurality of spectral weights comprises the step of calculating a plurality of LPC coefficients based on the input frame of speech, the LPC coefficients being included in the speech characterization code.

7. A method of encoding an input frame of speech based on a plurality of candidate excitations, the plurality of candidate excitations being subdivided into a plurality of subsets, each of the subsets including a predetermined amount of the plurality of candidate excitations, the method comprising the steps of:

a) determining a plurality of spectral weights based on the input frame of speech;

b) determining a target excitation based on the input frame of speech;

c) selecting from the plurality of candidate excitations the candidate excitation most closely matching the target excitation;

d) identifying the selected candidate excitation by a variable length index code having a data length based on the predetermined amount of candidate excitations included in the subset corresponding to the selected candidate excitation;

e) communicating a speech characterization code, the speech characterization code including at least the variable length index code and the plurality of the spectral weights calculated in step a);

f) receiving the speech characterization code communicated in step e);

g) determining, based on the plurality of spectral weights included in the speech characterization code, the subset of candidate excitations which includes the selected candidate excitation;

h) obtaining the selected candidate excitation from the subset determined in step g) by using the variable length index code; and i) reconstructing the input frame of speech based on the obtained candidate excitation, wherein the step h) of obtaining the selected candidate excitation comprises:

j) determining within the speech characterization code a first bit position of the variable length index code;

k) determining how many candidate excitations are included in the subset determined in step g);

l) determining the minimum number of bits necessary to uniquely identify the candidate excitations included in the subset determined in step g);

m) reading, from the beginning bit position of the variable length index code in the speech characterization code, a number of bits equal to the minimum number of bits determined in step l), the variable length index code comprising the bits read in step m); and n) obtaining the candidate excitation selected in step c) on the basis of the value of the index code.

8. A method of encoding an input frame of speech based on a plurality of candidate excitations, each candidate excitation being associated with a fixed amount of spectral weights, the plurality of candidate excitations being subdivided into a plurality of subsets, each of the subsets including a predetermined amount of the plurality of candidate excitations, the method comprising the steps of:

a) determining a fundamental frequency of the input frame of speech;

b) determining a first plurality of spectral weights based on the input frame of speech;

c) generating a second plurality of spectral weights based on the first plurality of spectral weights, the second plurality of spectral weights having an amount of spectral weights equal to the fixed amount of spectral weights;

d) selecting from the plurality of candidate excitations a candidate excitation most closely matching the input frame of speech on the basis of the second plurality of spectral weights;

e) identifying the selected candidate excitation by a variable length index code having a data length based on the predetermined amount of candidate excitations included in the subset corresponding to the selected candidate excitation;

f) communicating a speech characterization code without communicating the selected candidate excitation, the speech characterization code including at least the variable index code, the fundamental frequency, and the first plurality of spectral weights determined in step b);

g) receiving the speech characterization code communicated in step f);

h) determining the second plurality of spectral weights based on the received first plurality of spectral weights; and i) determining, based on the second plurality of spectral weights, the subset of candidate excitations including the selected candidate excitation.

9. The method according to step 8, further comprising the steps of:

j) obtaining the selected candidate excitation from the subset determined in step i) on the basis of the variable length index code;

k) generating a modified excitation based on the selected candidate excitation, the modified excitation corresponding to a number of frequency bands equal to the first amount of spectral weights; and l) reconstructing the input frame of speech on the basis of the modified excitation.

10. The method according to claim 9, wherein each of the plurality of candidate excitations comprises a plurality of values, each of the plurality of values corresponding to one of a voiced decision and an unvoiced decision.

11. The method according to claim 10, wherein each voiced decision is characterized by a sinusoid signal and each unvoiced decision is characterized by a white noise signal.

12. A method of encoding an input frame of speech based on a plurality of candidate excitations, each candidate excitation being associated with a fixed amount of spectral weights, the plurality of candidate excitations being subdivided into a plurality of subsets, each of the subsets including a predetermined amount of the plurality of candidate excitations, the method comprising the steps of:

a) determining a fundamental frequency of the input frame of speech;

b) determining a first plurality of spectral weights based on the input frame of speech;

c) generating a second plurality of spectral weights based on the first plurality of spectral weights, the second plurality of spectral weights having an amount of spectral weights equal to the fixed amount of spectral weights;

d) selecting from the plurality of candidate excitations a candidate excitation most closely matching the input frame of speech on the basis of the second plurality of spectral weights;

e) identifying the selected candidate excitation by a variable length index code having a data length based on the predetermined amount of candidate excitations included in the subset corresponding to the selected candidate excitation;

f) communicating a speech characterization code including at least the variable index code, the fundamental frequency, and the first plurality of spectral weights determined in step b);

g) receiving the speech characterization code communicated in step f);

h) determining the second plurality of spectral weights based on the received first plurality of spectral weights;

i) determining, based on the second plurality of spectral weights, the subset of candidate excitations including the selected candidate excitation;

j) obtaining the selected candidate excitation from the subset determined in step i) on the basis of the variable length index code;

k) generating a modified excitation based on the selected candidate excitation, the modified excitation corresponding to a number of frequency bands equal to the first plurality of spectral weights; and l) reconstructing the input frame of speech on the basis of the modified excitation, wherein each of the plurality of candidate excitations comprises a plurality of values, each of the plurality of values corresponding to one of a voiced decision and an unvoiced decision, and wherein each one of the frequency bands corresponding to the modified excitation includes one of the plurality of values.

13. An apparatus for encoding an input frame of speech based on a plurality of candidate excitations, the plurality of candidate excitations being subdivided into a plurality of subsets, each of the subsets including a predetermined amount of the plurality of candidate excitations, the apparatus comprising:

a) means for determining a plurality of spectral weights based on the input frame of speech;

b) means for determining a target excitation based on the input frame of speech;

c) means for selecting from the plurality of candidate excitations the candidate excitation most closely matching the target excitation;

d) means for identifying the selected candidate excitation by a variable length index code having a data length based on the predetermined amount of candidate excitations included in the subset corresponding to the selected candidate excitation;

e) means for communicating a speech characterization code without communicating the selected candidate excitation, the speech characterization code including at least the variable length index code and the plurality of the spectral weights calculated by the means for determining the plurality of spectral weights;

f) means for receiving the speech characterization code communicated by the means for communicating the speech characterization code; and g) means for determining, based on the plurality of spectral weights included in the speech characterization code, the subset of candidate excitations which includes the selected candidate excitation.

14. An apparatus for encoding an input frame of speech based on a plurality of candidate excitations, the plurality of candidate excitations being subdivided into a plurality of subsets, each of the subsets including a predetermined amount of the plurality of candidate excitations, the apparatus comprising:

a) means for determining a plurality of spectral weights based on the input frame of speech;

b) means for determining a target excitation based on the input frame of speech;

c) means for selecting from the plurality of candidate excitations the candidate excitation most closely matching the target excitation;

d) means for identifying the selected candidate excitation by a variable length index code having a data length based on the predetermined amount of candidate excitations included in the subset corresponding to the selected candidate excitation;

e) means for communicating a speech characterization code, the speech characterization code including at least the variable length index code and the plurality of the spectral weights calculated by the means for determining the plurality of spectral weights;

f) means for receiving the speech characterization code communicated by the means for communicating;

g) means for determining, based on the plurality of spectral weights included in the speech characterization code, the subset of candidate excitations which includes the selected candidate excitation;

h) means for obtaining the selected candidate excitation from the subset determined by the means for determining the subset of candidate excitations which includes the selected candidate excitation by using the variable length index code; and i) means for reconstructing the input frame of speech based on the obtained candidate excitation, wherein the means for obtaining the selected candidate excitation comprises:

j) means for determining within the speech characterization code a first bit position of the variable length index code;

k) means for determining how many candidate excitations are included in the subset determined by the means for determining the subset of candidate excitations which includes the selected candidate excitation;

l) means for determining the minimum number of bits necessary to uniquely identify the candidate excitations included in the subset determined by the means for determining the subset of candidate excitations which includes the selected candidate excitation;

m) means for reading, from the beginning bit position of the variable length index code in the speech characterization code, a number of bits equal to the minimum number of bits determined by the means for determining the minimum number of bits, the variable length index code comprising the bits read by the means for reading; and n) means for obtaining the candidate excitation selected by the means for selecting on the basis of the value of the index code.

15. An apparatus for encoding an input frame of speech based on a plurality of candidate excitations, each candidate excitation being associated with a fixed amount of spectral weights, the plurality of candidate excitations being subdivided into a plurality of subsets, each of the subsets including a predetermined amount of the plurality of candidate excitations, the apparatus comprising:

a) means for determining a fundamental frequency of the input frame of speech;

b) means for determining a first plurality of spectral weights based on the input frame of speech;

c) means for generating a second plurality of spectral weights based on the first plurality of spectral weights, the second plurality of spectral weights having an amount of spectral weights equal to the fixed amount of spectral weights;

d) means for selecting from the plurality of candidate excitations a candidate excitation most closely matching the input frame of speech on the basis of the second plurality of spectral weights;

e) means for identifying the selected candidate excitation by a variable length index code having a data length based on the predetermined amount of candidate excitations included in the subset corresponding to the selected candidate excitation; and f) means for communicating a speech characterization code without communicating the selected candidate excitation, the speech characterization code including at least the variable index code, the fundamental frequency, and the first plurality of spectral weights determined by the means for determining the first plurality of spectral weights;

g) means for receiving the speech characterization code communicated by the means for communicating the speech characterization code;

h) determining the second plurality of spectral weights based on the received first plurality of spectral weights; and i) determining, based on the second plurality of candidate excitations, the subset of candidate excitations including the selected candidate excitation.

16. An apparatus for encoding an input frame of speech based on a plurality of candidate excitations, each candidate excitation being associated with a fixed amount of spectral weights, the plurality of candidate excitations being subdivided into a plurality of subsets, each of the subsets including a predetermined amount of the plurality of candidate excitations, the apparatus comprising:

a) means for determining a fundamental frequency of the input frame of speech;

b) means for determining a first plurality of spectral weights based on the input frame of speech;

c) means for generating a second plurality of spectral weights based on the first plurality of spectral weights, the second plurality of spectral weights having an amount of spectral weights equal to the fixed amount of spectral weights;

d) means for selecting from the plurality of candidate excitations a candidate excitation most closely matching the input frame of speech on the basis of the second plurality of spectral weights;

e) means for identifying the selected candidate excitation by a variable length index code having a data length based on the predetermined amount of candidate excitations included in the subset corresponding to the selected candidate excitation;

f) means for communicating a speech characterization code including at least the variable index code, the fundamental frequency, and the first plurality of spectral weights determined by the means for determining the first plurality of spectral weights;

g) means for receiving the speech characterization code communicated by the means for communicating the speech characterization code;

h) means for determining the second plurality of spectral weights based on the received first plurality of spectral weights;

i) means for determining, based on the second plurality of spectral weights, the subset of candidate excitations including the selected candidate excitations;

j) means for obtaining the selected candidate excitation from the subset determined by the means for determining the subset of candidate excitation on the basis of the variable length index code;

k) means for generating a modified excitation based on the selected candidate excitation, the modified excitation corresponding to a number of frequency bands equal to the first plurality of spectral weights; and l) means for reconstructing the input frame of speech on the basis of the modified excitation, wherein each of the plurality of candidate excitations comprises a plurality of values, each of the plurality of values corresponding to one of a voiced decision and an unvoiced decision, and wherein each one of the frequency bands corresponding to the modified excitation includes one of the plurality of values.

17. An apparatus for encoding an input frame of speech based on a plurality of candidate excitations, the plurality of candidate excitations being subdivided into a plurality of subsets, each of the subsets including a predetermined amount of the plurality of candidate excitations, the apparatus comprising:

a) a device including a spectral weight calculator for determining a plurality of spectral weights based on the input frame of speech;

b) a device including a target excitation calculator for determining a target excitation based on the input frame of speech;

c) a device including an adaptive searcher and a stochastic searcher for selecting from the plurality of candidate excitations the candidate excitation most closely matching the target excitation;

d) a device including a spectral weight correlator for identifying the selected candidate excitation by a variable length index code having a data length based on the predetermined amount of candidate excitations included in the subset corresponding to the selected candidate excitation;

e) a device including an encoder for communicating a speech characterization code without communicating the selected candidate excitation, the speech characterization code including at least the variable length index code and the plurality of the spectral weights calculated by the device including the spectral weight calculator;

f) a device including a decoder for receiving the speech characterization code communicated by the device including the encoder; and g) a device including a cluster generator for determining, based on the plurality of spectral weights included in the speech characterization code, the subset of candidate excitations which includes the selected candidate excitation.

18. An apparatus for encoding an input frame of speech based on a plurality of candidate excitations, the plurality of candidate excitations being subdivided into a plurality of subsets, each of the subsets including a predetermined amount of the plurality of candidate excitations, the apparatus comprising:

a) a device including a spectral weight calculator for determining a plurality of spectral weights based on the input frame of speech;

b) a device including a target excitation calculator for determining a target excitation based on the input frame of speech;

c) a device including an adaptive searcher and a stochastic searcher for selecting from the plurality of candidate excitations the candidate excitation most closely matching the target excitation;

d) a device including a first spectral weight correlator for identifying the selected candidate excitation by a variable length index code having a data length based on the predetermined amount of candidate excitations included in the subset corresponding to the selected candidate excitation;

e) a device including an encoder for communicating a speech characterization code, the speech characterization code including at least the variable length index code and the plurality of the spectral weights calculated by the device including the spectral weight calculator;

f) a device including a decoder for receiving the speech characterization code communicated by the device including the encoder;

g) a device including a cluster generator for determining, based on the plurality of spectral weights included in the speech characterization code, the subset of candidate excitations which includes the selected candidate excitation;

h) a device including a second spectral weight correlator for obtaining the selected candidate excitation from the subset determined by the device including the cluster generator for determining the subset of candidate excitations which includes the selected candidate excitation by using the variable length index code; and i) a device including an LPC filter for reconstructing the input frame of speech based on the obtained candidate excitation, wherein the device including the second spectral weight correlator comprises:

j) a device for determining within the speech characterization code a first bit position of the variable length index code;

k) a device for determining how many candidate excitations are included in the subset determined by the device including the cluster generator;

l) a device for determining the minimum number of bits necessary to uniquely identify the candidate excitations included in the subset determined by the device including the cluster generator;

m) a device for reading, from the beginning bit position of the variable length index code in the speech characterization code, a number of bits equal to the minimum number of bits determined by the device for determining the minimum number of bits, the variable length index code comprising the bits read by the device for reading; and n) a device for obtaining the candidate excitation selected by the device including the adaptive searcher and the stochastic searcher on the basis of the value of the index code.

19. An apparatus for encoding an input frame of speech based on a plurality of candidate excitations, each candidate excitation being associated with a fixed amount of spectral weights, the plurality of candidate excitations being subdivided into a plurality of subsets, each of the subsets including a predetermined amount of the plurality of candidate excitations, the apparatus comprising:

a) a device including a pitch frequency calculator for determining a fundamental frequency of the input frame of speech;

b) a device including a spectral envelope generator for determining a first plurality of spectral weights based on the input frame of speech;

c) a device including an in-band generator and an interpolator/decimator for generating a second plurality of spectral weights based on the first plurality of spectral weights, the second plurality of spectral weights having an amount of spectral weights equal to the fixed amount of spectral weights;

d) a device including an excitation searcher for selecting from the plurality of candidate excitations a candidate excitation most closely matching the input frame of speech on the basis of the second plurality of spectral weights, wherein the excitation searcher identifies the selected candidate excitation by a variable length index code having a data length based on the predetermined amount of candidate excitations included in the subset corresponding to the selected candidate excitation; and e) a device including an encoder for communicating a speech characterization code including at least the variable index code, the fundamental frequency, and the first plurality of spectral weights determined by the device including the spectral envelope generator and excluding the selected candidate excitation.

20. An apparatus for encoding an input frame of speech based on a plurality of candidate excitations, each candidate excitation being associated with a fixed amount of spectral weights, the plurality of candidate excitations being subdivided into a plurality of subsets, each of the subsets including a predetermined amount of the plurality of candidate excitations, the apparatus comprising:

a) a device including a pitch frequency calculator for determining a fundamental frequency of the input frame of speech;

b) a device including a spectral envelope generator for determining a first plurality of spectral weights based on the input frame of speech;

c) a device including an in-band generator and a first interpolator/decimator for generating a second plurality of spectral weights based on the first plurality of spectral weights, the second plurality of spectral weights having an amount of spectral weights equal to the fixed amount of spectral weights;

d) a device including a first excitation searcher for selecting from the plurality of candidate excitations a candidate excitation most closely matching the input frame of speech on the basis of the second plurality of spectral weights, wherein the first excitation searcher identifies the selected candidate excitation by a variable length index code having a data length based on the predetermined amount of candidate excitations included in the subset corresponding to the selected candidate excitation;

e) a device including an encoder for communicating a speech characterization code including at least the variable index code, the fundamental frequency, and the first plurality of spectral weights determined by the device including the spectral envelope generator;

f) a device including a decoder for receiving the speech characterization code communicated by the device including the encoder;

g) a device including a second interpolator/decimator for determining the second plurality of spectral weights based on the received first plurality of spectral weights;

h) a device including a second excitation searcher for determining, based on the second plurality of spectral weights, the subset of candidate excitations including the selected candidate excitation, wherein the second excitation searcher obtains the selected candidate excitation from the subset determined by the second excitation searcher on the basis of the variable length index code;

j) a device including a third interpolator/decimator for generating a modified excitation based on the selected candidate excitation, the modified excitation corresponding to a number of frequency bands equal to the first plurality of spectral weights; and k) a device including a synthesizer for reconstructing the input frame of speech on the basis of the modified excitation, wherein each of the plurality of candidate excitations comprises a plurality of values, each of the plurality of values corresponding to one of a voiced decision and an unvoiced decision, and wherein each one of the frequency bands corresponding to the modified excitation includes one of the plurality of values.

* * * * *